United States Patent [19]

Lee

[11] 4,392,756

[45] Jul. 12, 1983

[54] SERIAL PRINTING APPARATUS

[75] Inventor: Hyun C. Lee, Seoul, Rep. of Korea

[73] Assignee: Gold Star Company, Ltd., Seoul, Rep. of Korea

[21] Appl. No.: 216,898

[22] Filed: Dec. 16, 1980

[30] Foreign Application Priority Data

Dec. 31, 1979 [KR] Rep. of Korea ..... 79/7894[U]

[51] Int. Cl.[3] ..... B41J 1/30

[52] U.S. Cl. ..... 400/144.2; 101/93.19

[58] Field of Search ..... 400/144.2, 144.3; 101/93.19

[56] References Cited

U.S. PATENT DOCUMENTS 3,651,915 3/1972 Folkens ..... 400/144.3

3,651,916 3/1972 Becchi ..... 400/144.3

FOREIGN PATENT DOCUMENTS 1561261 2/1970 Fed. Rep. of Germany ... 400/144.2

55-118868 9/1980 Japan ..... 400/144.2

OTHER PUBLICATIONS

PCT/CH79/00018, published Aug. 23, 1979, Gagnebin.

*Primary Examiner*—Paul T. Sewell

*Attorney, Agent, or Firm*—Ladas & Parry

[57] ABSTRACT

A printing apparatus comprising a printwheel with a hub and spokes extending therefrom, each of the spokes having at least two different types of character slugs thereon; a rotatable printwheel; a motor for shifting the printwheel up or down and for rotating the printwheel, so as to place a selected slug at a desired printing location; and a second motor for driving the printwheel up or down.

3 Claims, 5 Drawing Figures

SERIAL PRINTING APPARATUS

The present invention relates to a serial printing apparatus comprising a dual line printwheel which has a hub and spokes extending from the hub and carries two character slugs on each spoke.

In the type of serial printing apparatus disclosed in U.S. Pat. No. 4,106,611, the operation of shifting the rotary hubs up or down is accomplished by a universal joint that links the print wheel and its drive means. In this apparatus, the universal joint is used because the center line of the printwheel does not coincide with the shaft of the motor for rotating the printwheel. In such an apparatus which utilizes a universal joint to link the printwheel and its drive means, there can be an increased error in placing the character slugs at the desired printing position because of the wearout and/or clearance of the joint. The wearout of the joint can be severe with excessive mechanical drive. In addition, the load applied to the drive means for rotating the print wheel can be increased.

The object of the present invention is to provide a serial printing apparatus by which the character slugs on the inner and outer line can be placed at an accurate printing position, the printwheel can be rotated rapidly resulting in increased printing speed, and the drive means can rotate the printwheel with a reduced load. In the following the embodiment of the present invention is described in detail with the accompanying drawings in which.

Figure 1:
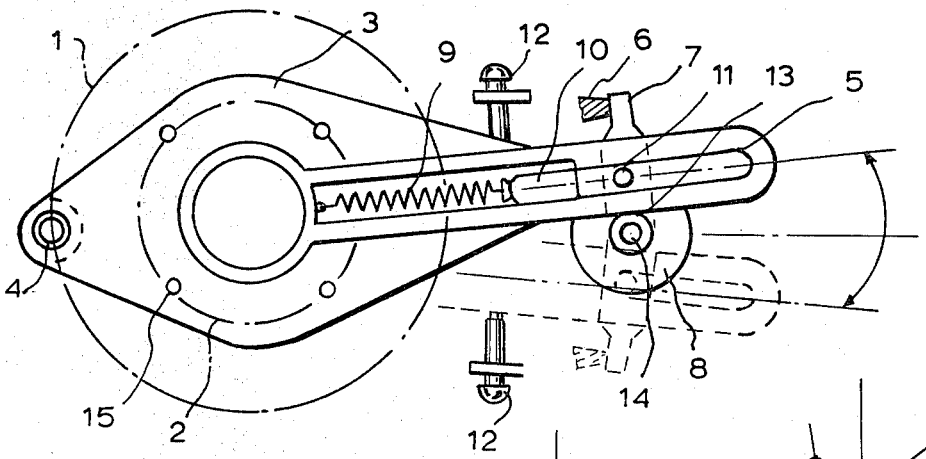
FIG. 1 is a front view describing the operation of the present invention.
Figure 5:
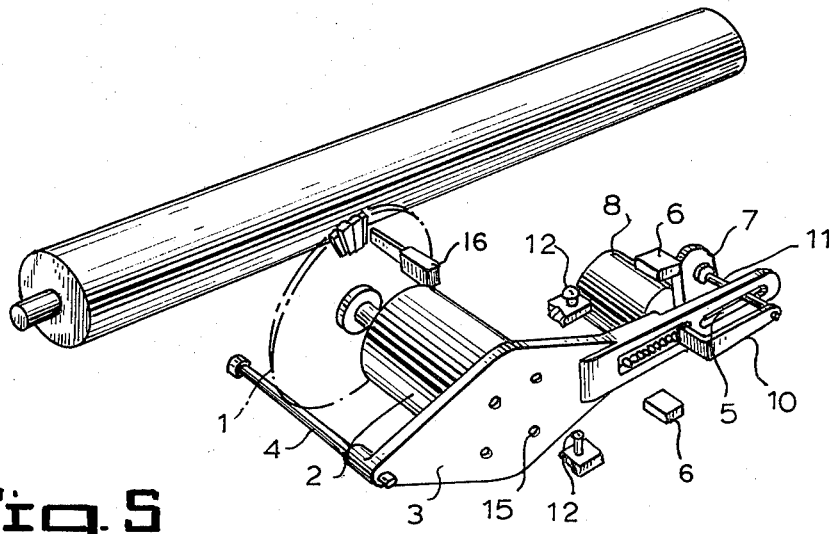
FIG. 5 illustrates a shifting mechanism embodying the present invention.

Refering to FIG. 1 and FIG. 5, at one side of the latch base (3) which is attached to the motor (2) for rotating printwheel (1), hinge (4) and at the other side slot (5) are provided, through which a crank pin (11) at crank arm (7) can be inserted. Crank arm (7) is attached to the shaft of the motor (8) for shifting the latch base and a spring bar (10) with a spring (9) is attached to the crank pin (11). The crank arm (7) rotates according to the rotation of the motor (8) which is operated for a short time, during which the cushions (6) act as buffers to stop the crank arm (7). Two bolts (12) control the position of the latch base (3) accurately. (13) and (14) indicate respectively the crank hub and the motor shaft and (15) indicates holes for attaching the motor (2) to the latch base (3). (16) indicates a hammer for printing characters of the printwheel. The operations of this apparatus are described as follows.

Figure 2:
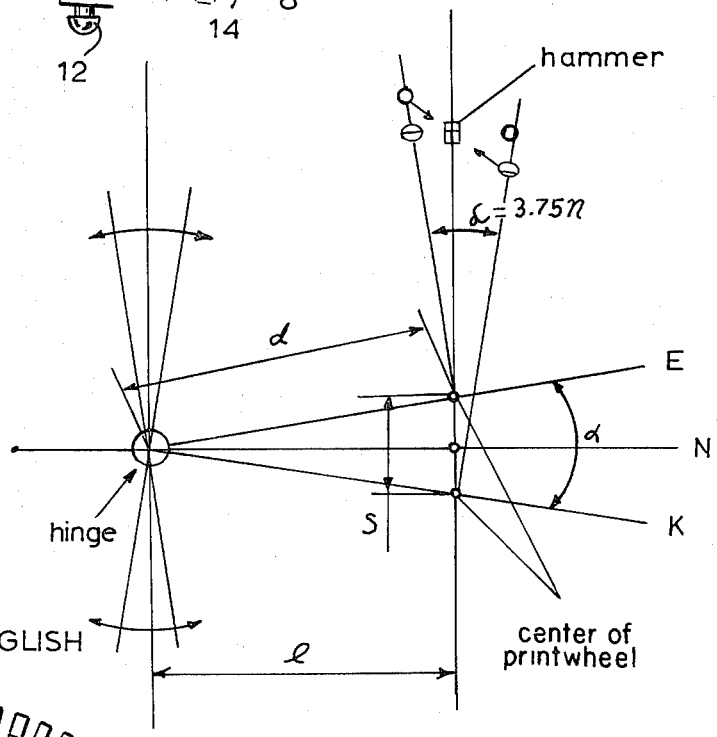
FIG. 2 shows the operation of the present invention.
Figure 3:
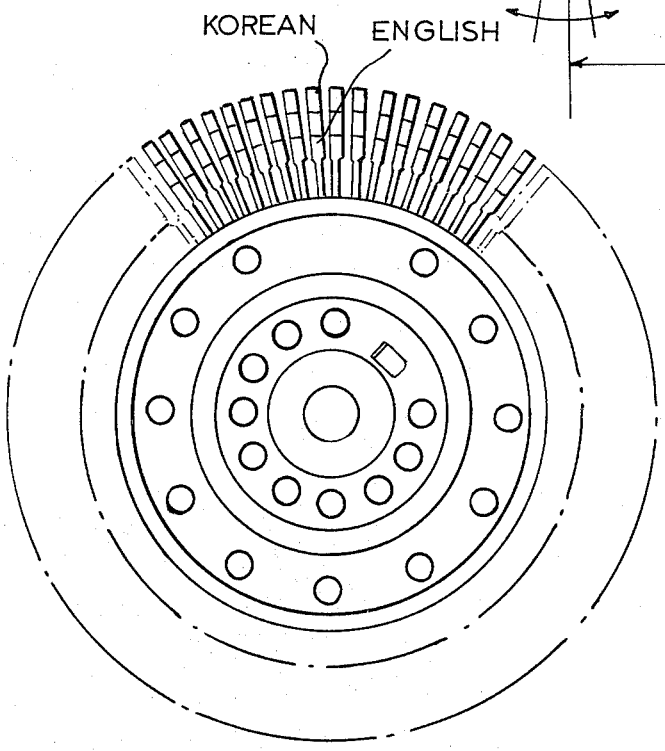
FIG. 3 is a fragmentary front view of the dual line printwheel.
Figure 4:
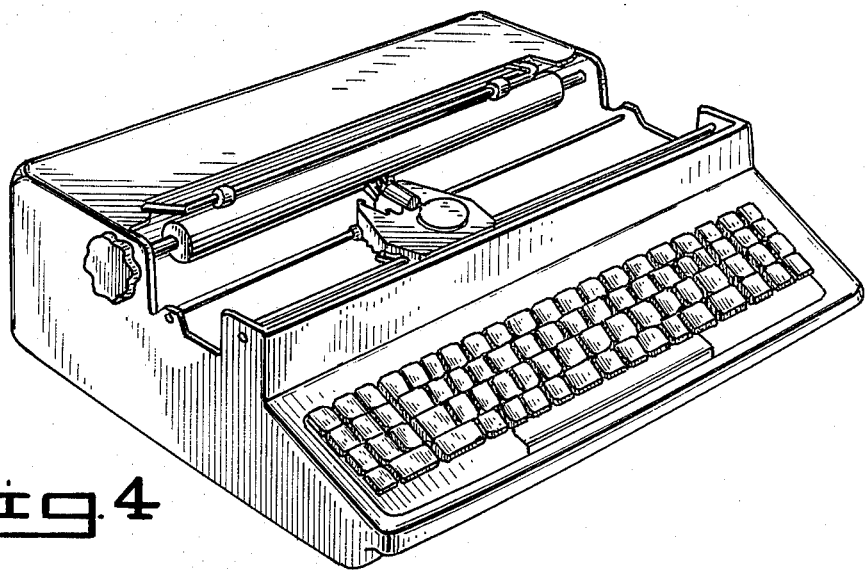
FIG. 4 illustrates an electronic typewriter which utilizes the present invention.

According to the polarity of the voltage applied to the motor (8), crank arm (7) rotates clockwise or counter clockwise. Then, the crank pin (11) starts to slide along the slot (5) and the latch base (3) moves up or down. Electric power is applied to the motor (8) during a predetermined time interval and removed when the crank arm rotates over the neutral position N. Then the tension of the spring (9) pulls the crank pin (11) through the spring bar (10) and accordingly the latch base (3) moves on until it reaches its stop position. Therefore, the center of the printwheel attached to the motor (2) shaft is shifted from the position E to the position K or vice versa with displacement of S as illustrated in FIG. 2. If the print wheel (1) is placed at position E, characters on the inner line are printed and otherwise, characters on the outer line are printed.

As illustrated in FIG. 2, the center of the printwheel (1) is always placed on the center line of the hammer (16) because it is shifted by the same distance from the neutral position N.

After the shifting operation, the spokes placed at the printing position just in front of the hammer (16) are displaced by the rotating effect of the printwheel. The rotation angle of the printwheel is equal to the rotation angle of the latch base noted as $\alpha$. Therefore, one can easily note that "n" must be an integral multiple of the angle between the neighboring spokes of the print wheel to place the character slugs at the desired printing position. For example, if the angle between the neighboring spokes of the printwheel is 3.75°, then $\alpha = 3.75° \times n$, where "n" is a number of displaced spokes and accordingly it has an integer value greater than zero. Therefore, "n" can be determined by determining the angle $\alpha$.

As described above, since both the print wheel and the motor for rotating it are shifted at the same time and positions can be controlled precisely by two bolts, the mechanism is simple but printing position error can be made very small.

One need not care about excessive drive or power problems, if characters are aligned in such a manner that the frequency of transition between the outer line and the inner line is low. For example, one can align Korean characters on the outer line and English characters on the inner line.

With the teaching of the above description, many modifications and variations will be possible without departing from the scope of this invention.

What is claimed is:

1. A printing apparatus comprising:

a printwheel with a hub and spokes extending therefrom, each of said spokes having at least two different types of character slugs thereon;

first drive means attached to the printwheel for rotating said printwheel;

shifting means attached to said first drive means for shifting said printwheel and said first drive means up or down with rotational motion to place a selected character slug at a desired printing position; said shifting means including:

a latchbase having a first and a second end;

a hinge connected to said first end of said latchbase;

a slot positioned in said latchbase near said second end of said latchbase;

a spring having a first and a second end, positioned in said slot, said first end of said spring being attached to one end of said slot;

a movable springbar connected to said second end of said spring; and a crank pin positioned in said slot, and attached to said springbar, said crank pin being for driving said latchbase by sliding along said slot; and second drive means for driving said shifting means.

2. Printing apparatus of claim 1, further comprising means for controlling the displacement of the shifting means.

3. A printing apparatus of claim 1, wherein the second drive means comprises a d.c. motor having a shaft; and a crank arm attached to said shaft and capable of rotation in either a clockwise or counter-clockwise direction;

said pin being attached to said crank arm.

* * * * *